US005899372A

United States Patent [19]

Rodriguez

[11] Patent Number: 5,899,372

[45] Date of Patent: May 4, 1999

[54] METHOD FOR OPENING A TAB ON A CARDBOARD BOX

[76] Inventor: Oscar Rodriguez, 434 E. Villaret, San Antonio, Tex. 78221

[21] Appl. No.: 08/942,706

[22] Filed: Oct. 1, 1997

Related U.S. Application Data

[63] Continuation of application No. 08/631,423, Apr. 12, 1996, abandoned.

[51] Int. Cl.[6] ..... B67B 7/00

[52] U.S. Cl. ..... 225/1; 225/93; 30/2

[58] Field of Search ..... 225/103, 93, 104; 7/151, 166; 30/2, 123, 402, 407, 414, 443, 444; 81/3.4, 3.41, 3.47, 3.48, 3.49, 3.55; 72/325, 326; D8/14; D12/162; D19/72; 53/382.1

[56] References Cited

U.S. PATENT DOCUMENTS

| | | | |
|---|---|---|---|
| 1,664,244 | 3/1928 | Cotton | 81/3.49 |
| 2,797,477 | 7/1957 | Erdman | 30/2 |
| 2,896,318 | 7/1959 | Brown | 30/2 |
| 2,913,821 | 11/1959 | Anderson | 30/402 |
| 3,262,621 | 7/1966 | Basabe | 225/103 |
| 3,289,289 | 12/1966 | Cambier Van Nooten | 81/3.55 X |
| 4,371,021 | 2/1983 | Converse et al. | 7/151 X |
| 4,398,314 | 8/1983 | Converse et al. | 7/151 |
| 4,745,829 | 5/1988 | VanHoutte et al. | 81/3.55 |
| 4,785,488 | 11/1988 | Schellas | 7/166 |
| 4,835,860 | 6/1989 | Infeld | 30/2 |

*Primary Examiner*—Clark F. Dexter
*Attorney, Agent, or Firm*—Miller, Sisson Chapman & Nash, P.C.

[57] ABSTRACT

A hand-held and operated package-opening tool designed to open packaging having score lines defining a tab at the opening site. The tool includes a handle and a flat base connected to one end of the handle. Attached to the base and extending away from the handle is a lip having a shape similar to the tab.

1 Claim, 2 Drawing Sheets

METHOD FOR OPENING A TAB ON A CARDBOARD BOX

This is a continuation of application Ser. No. 08/631,423 filed on Apr. 12, 1996, now abandoned.

BACKGROUND OF THE INVENTION

1. Field of the Invention

The present invention relates generally to a hand-held tool for opening a box. The present invention relates more specifically to a hand-held box opening tool used to quickly open a perforated tab on a box containing a syrup bag for carbonated beverages.

2. Description of the Related Art

Many shapes and sizes of packaging are available on the market today. Such packaging typically takes the shape of a box made from cardboard or plastic. These boxes are often sealed with glue or staples to prevent loss of the interior contents during transport or storage. However, once access to the contents is desired, such boxes may prove quite difficult to open. To facilitate their opening, the boxes may contain a line of perforations or score lines along an area most easily opened commonly referred to as a tab. Depending on the thickness of the material of the box and the effectiveness of the score lines, opening such boxes may still prove frustrating.

Tools for aiding the opening of such packaging have been devised to assist in their opening. Such tools are typically hand-held and accomplish their objective by cutting and sliding under a wall of the box at one of the box corners.

U.S. Pat. Nos. 4,371,021, and 4,398,314, issued to Converse et al., describe a box top opener for opening boxes which have their upper end enclosed by overlapping flaps held together with glue. The box top opener includes a handle, a flat plate attached to one end of the handle in a direction transverse to the length of the handle, and two, flat, parallel jaws which are attached to the plate opposite the side of the handle. The first jaw has a flat, rectangular shape and rides on top of the upper surface of the box top being opened. The second jaw which is spaced close to the first jaw is made of a triangular plate having a length between one-half and the full length of the first jaw. The triangular-shaped jaw has edges which are beveled, and it is this triangular second jaw which is inserted beneath the box top in order to open the box.

U.S. Pat. No. 4,835,860, issued to Infeld, describes a hand tool for opening a paperboard carton having a push-in tab at a top corner of the carton. This device has a spoon-shaped body with a handle and a pointed bowl member at one end of the handle. A rigid arm extends from the handle at the point where the bowl is attached to the handle and runs parallel out over the bowl, terminating in a free end about half the length of the bowl from its attachment to the handle. This free end is positioned on top of the box and the bowl is pressed against the push-in tab of the box. Then, the handle is lowered down pushing the bowl against the tab, thereby opening the box at the tab. At the far end of the bowl, there is a small projection which engages the bottom edge of the pushed-in tab on the carton so that it can be pulled out from inside the carton.

These prior art opening tools have their limitations. They are relatively complicated to use and are restricted to use on particular kinds of packaging. For example, the invention described by Converse is designed for use on boxes which have their upper end enclosed by overlapping flaps held together with glue. Likewise, the opener described by Infeld is limited to opening paperboard cartons with a lever-type movement.

As generally described above, the package opening tool of the present invention has practical application in a number of situations involving the opening of a pre-scored tab on the package. The tool has specific application in the soft drink industry for opening the box packaging surrounding pliable plastic bags of soft drink syrup used extensively throughout the industry. The soft drink industry manufactures and transports soft drink syrup separate from the carbonated water which is later combined with the syrup to create the carbonated beverage. Such syrups are typically stored in plastic, soft-sided bags which are easily sealed for sanitary purposes. The syrup bags have a spigot from which the syrup is dispensed. However, due to the difficulty in storing and transporting the bags of syrup, each bag is placed inside a rigid box-shaped container. This combination of syrup bag and box are commonly referred to in the industry as a "bag-in-box" or a "BIB". Typically, the outer, more sturdy package is a rectangular cardboard box. One side of the BIB contains pre-scored lines creating a tab in the side of the box which has a generally triangular shape. The outer box of the BIB must be opened along this tab to access the spigot located in the syrup bag. Although the BIBs have their advantages, they are not easily opened.

A typical soft drink distributor must unload and open many BIBs a day for the purchasers so that the spigot within each may be accessed. Some distributors use their hand to open the tab, while others use a sharp object such as a knife. However, neither method works well. Over time, the distributors that use their hands may cause damage to their hands from repeatedly opening the BIBs. Those distributors that use a sharp object to open the BIB often tear the syrup bag in the process, resulting in damaged product and lost product sales. A simple and efficient means of accessing the syrup bag through the outer box of the BIB without damaging the syrup bag is therefore required.

It is, therefore, a primary object of this invention to provide a simple tool which is easy to use to open a wide variety of packages containing pre-scored lines.

It is another object of the present invention to provide a hand-held package opening tool which is easily manufactured.

It is a further object of the present invention to provide a package-opening tool which is easy to use.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

According to the present invention, the foregoing and other objects and advantages are attained by a portable hand-held tool designed to open packaging having score lines defining a tab at the opening site. The package-opening tool operates like a punch to efficiently open the package along the pre-existing score lines.

The package-opening tool includes a handle, and a base connected to one end of the handle. Connected to the base and extending away from the handle is a lip which may be designed to have a shape similar to the portion of the package defined by the score lines. Use of the tool to open a package includes gripping the tool by the handle and aligning it with the surface of the package containing the score lines such that the handle is generally perpendicular to the surface. In addition, the tool is positioned such that the lip is aligned with the package tab as defined by the score lines. Once the tool has been properly aligned, a single thrust of the opener toward the package such that the opener lip and base contact the package tab will efficiently sever the tab from the body of the package along the score lines. This is accomplished without injury to the person opening the box while virtually eliminating any damage to the contents of the package.

Still other objects and advantages of the present invention will become readily apparent to those skilled in this art from the following detailed description, wherein multiple preferred embodiments of the invention are shown and described, simply by way of illustration of the best mode contemplated by the inventor for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE PREFERRED EMBODIMENT

As generally described above, the device of the present invention has practical application in a number of situations involving the opening of a package having a pre-scored tab. In a preferred embodiment, the tool may be used to facilitate the opening of an outer box of a bag-in-box, or BIB, along pre-scored lines in order to access a plastic bag containing soft drink syrup inside the box. The tool aids in opening the outer, typically cardboard, box of the BIB without rupturing the syrup bag inside.

Figure 1:
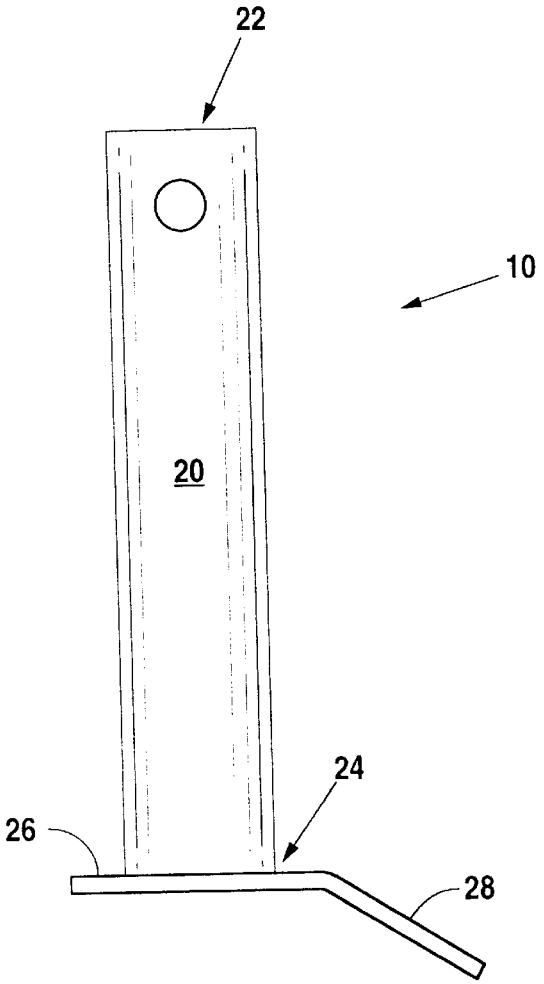
FIG. 1 is a side elevation view of a preferred embodiment of the package tab opener of the present invention.

Reference is made, therefore, to FIG. 1 for a description of a preferred embodiment of the current invention. FIG. 1 shows a side elevation of the basic package opener (10) having several components. The opener (10) consists of a grippable, elongated handle (20) which has a cylindrical shape. The handle (20) has a top (22) and a bottom (24). Near the top (22), the handle (20) has a hole (25) through it. The through-hole (25) allows the opener (10) to be hung on a peg board or work belt, or to have a cord (not shown) passed through the through-hole (25) for suspending the opener (10) by the cord. The handle (20) is not limited to a cylindrical shape but may have any shape which aids in holding the opener (10) with the human hand.

Figure 2:
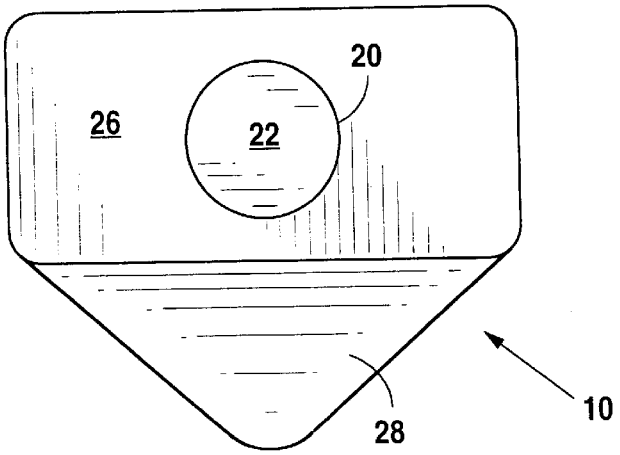
FIG. 2 is a top plan view of the package tab opener of the present invention.

In the preferred embodiment, the handle (20) is hollow and is composed of stainless steel. The handle (20) is approximately 4–5 inches long; however, the length of the handle may be varied over a range of 3–12 inches as needed, based on the hand-size of the user of the opener (10) and the specific application for which it is used. Attached to the bottom (24) of the handle (20) is a flat base (26). The base (26) is generally rectangular in shape and is approximately ⅛-inch thick. The plane of the base (26) is generally perpendicular to the axis of the handle (20). The base (26) is also composed of stainless steel and is typically welded to the handle (20). Alternatively, the base (26) may be composed of hard plastic, wood or any other suitably sturdy material and may have any shape. Attached along one edge of the base is a protruding lip (28). The lip (28) extends in a direction opposite the handle (20) at approximately a 45 degree angle from the plane of the base (26). In the preferred embodiment, the lip (28) has approximately the same thickness as the base (26) and is formed from the same material. However, the lip (28) may consist of a completely different material than that of the base (26) as long as the lip (28) is securely attached to the base (26). In the preferred embodiment, the lip (28) has a shape similar to that of the tab (36) but slightly smaller. The lip (28) also has a rounded or curved edge (38) which helps avoid damage to the contents of the BIB (30) during the opening process. FIG. 2 shows a top view of the preferred embodiment of the package opener (10) of the present invention.

Figure 3:
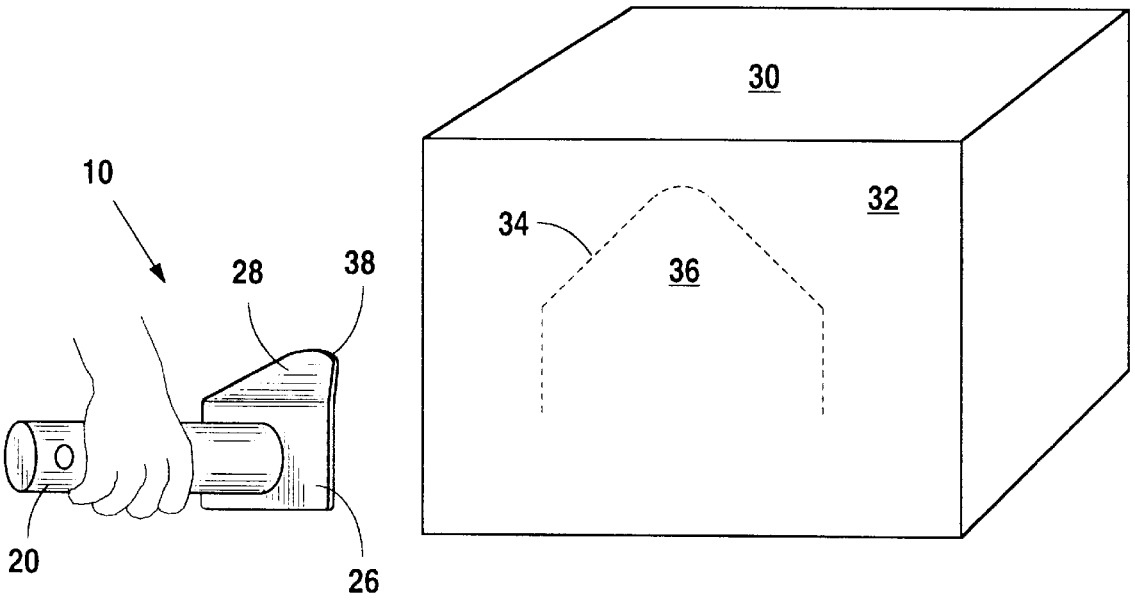
FIG. 3 is a side perspective view of the package tab opener of the present invention aligned with a tab in a package to be opened.

FIG. 3 depicts the use of the package opener (10) to open a BIB (30) according to the present invention. The BIB (30) is a rectangular box, typically made from sturdy cardboard, which houses the soft drink beverage syrup-containing bag (not shown). In one side (32) of the BIB (30) is located a tab (36) which is defined by perforated score lines (34) made in the side (32). It is this tab (36) which the opener (10) of the present invention releases along the score lines (34) thereby providing access to the internal syrup bag. This is accomplished by grasping the opener (10) by the handle (20) and aligning the lip (28) with the tab (36) in the BIB (30). The alignment of the opener (10) should be such that the base (26) is generally parallel to the side (32) of the BIB (30) to be opened. A single thrust of the opener (10) toward the side (32) such that the lip (28) and base (26) squarely contact the tab (36) results in the application of enough force to the tab (36) to break it free from the side (32) along the score lines (34). It should also be noted that the angle of the lip as well as its rounded shape significantly reduce the likelihood that opening the BIB (30) will result in a puncture or tear in the interior syrup bag. As the user of the device (10) becomes more proficient, a single movement with the opener (10) will result in the opening of the BIB (30) as well as contact with the syrup spigot (not shown) just inside the tab (36) such that the spigot protrudes from the BIB (30) after opening, thereby facilitating access to the syrup.

While the preferred embodiment for the present invention has been described in conjunction with the opening of a BIB, the opener (10) may aid in the opening of a wide variety of containers and packages. This includes packaging made of wood or plastic, as well as those made from corrugated cardboard or paper board as herein previously described. In addition, the opening tool (10) itself need not be constructed from stainless steel, but may be made from a wide variety of materials, including other metals, hard plastic, or wood. The various components of the opening tool may be manufactured from a single material such as by injection or compression molding, or may be composed of different materials secured together with glue or other bonding means.

It is intended that the above description of the preferred embodiment of the structure of the present invention and the description of its construction and use is but one enabling best mode embodiment for implementing the invention. Other applications are likely to be conceived of by those skilled in the art, which applications still fall within the breadth and scope of the disclosure of the present invention. The primary import of the present invention lies in its simple design and method of use for opening packages containing a perforated tab. Its benefits derive from its efficiency and corresponding low cost. Again, it is understood that other applications of the present invention will be apparent to those skilled in the art upon a reading of the preferred embodiment and a consideration of the appended claims and drawings.

I claim:

1. A method for using a hand-held tool for opening a rectangular cardboard box, said box having a planar wall with a line of perforations or score lines defining a tab, the method comprising the steps of:

providing the hand-held tool in the form of a package tab opener, said package tab opener comprising an elongated handle having a first end, a second end and a longitudinal axis extending between said ends, said opener further comprising a rigid member disposed on one of said first and second ends, said rigid member having a flat base portion substantially perpendicular to the longitudinal axis of the handle and a lip portion extending from said flat base portion, wherein said lip portion makes an obtuse angle with the flat base portion, wherein the rigid member has a perimeter substantially corresponding in shape to the tab of the box, and wherein said handle and said lip portion extend from said flat base portion in generally opposite directions;

grasping the elongated handle of the opener;

positioning the opener with the rigid member adjacent to the planar wall of the box and aligning the lip portion and the base portion with correspondingly-shaped portions of the tab;

breaking at least a portion of the tab free from the planar wall by thrusting the opener against the tab such that at least the lip portion contacts the respective correspondingly-shaped portion of the tab, and then penetrating the planar wall of the box with the rigid member to progressively separate the tab from the planar wall; and removing the rigid member from the box.

* * * * *